US009771228B2

(12) United States Patent
Mizuno et al.

(10) Patent No.: US 9,771,228 B2
(45) Date of Patent: Sep. 26, 2017

(54) SHEET FEEDING DEVICE, SHEET FEEDING METHOD, AND IMAGE FORMING APPARATUS

(71) Applicant: KONICA MINOLTA, INC., Chiyoda-ku (JP)

(72) Inventors: Hiroshi Mizuno, Aisai (JP); Atsuhiko Shimoyama, Tahara (JP); Noboru Oomoto, Toyokawa (JP); Hiroaki Umemoto, Osaka (JP); Ryo Oshima, Anjo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/331,346

(22) Filed: Jul. 15, 2014

(65) Prior Publication Data

US 2015/0021848 A1 Jan. 22, 2015

(30) Foreign Application Priority Data

Jul. 17, 2013 (JP) ..... 2013-148237

(51) Int. Cl.
*B65H 5/22* (2006.01)
*B65H 3/12* (2006.01)
(Continued)

(52) U.S. Cl.
CPC ..... *B65H 5/224* (2013.01); *B65H 3/128* (2013.01); *B65H 3/48* (2013.01); *B65H 5/228* (2013.01);
(Continued)

(58) Field of Classification Search
CPC ..... B65H 5/22; B65H 5/222; B65H 5/224; B65H 3/48; B65H 3/124; B65H 3/128; B65H 7/16; B65H 2515/342
(Continued)

(56) References Cited

U.S. PATENT DOCUMENTS 5,645,274 A * 7/1997 Ubayashi et al. ..... 271/94
5,707,056 A * 1/1998 Rauen et al. ..... 271/96
(Continued)

FOREIGN PATENT DOCUMENTS

JP H09-194059 A 7/1997
JP H09-202469 A 8/1997
(Continued)

OTHER PUBLICATIONS

Decision to Grant a Patent issued by the Japan Patent Office on Jul. 28, 2015 in corresponding Japanese Application No. 2013-148237, and English language translation of Office Action (6 pages).
(Continued)

*Primary Examiner* — Ernesto Suarez
(74) *Attorney, Agent, or Firm* — Buchanan Ingersoll & Rooney PC

(57) ABSTRACT

A sheet feeding device has a mounting portion allowing a stack of sheets to be mounted in a top-bottom direction, a suction/transportation portion provided above the mounting portion for attracting a first sheet positioned on top of the stack, and a blowing portion for blowing air to a foremost edge of the first sheet in a transportation direction while the first sheet is being attracted by the suction/transportation portion, thereby separating the first sheet from a second sheet next to the first sheet. After the first sheet is separated from the second sheet, the suction/transportation portion transports the first sheet in the transportation direction. The suction/transportation portion sets a suction force applied to the foremost edge of the first sheet smaller when the blowing portion blows air to the first sheet than when the suction/transportation portion transports the first sheet.

12 Claims, 15 Drawing Sheets

(51) Int. Cl.

| | |
|---|---|
| ***B65H 3/48*** | (2006.01) |
| ***B65H 7/14*** | (2006.01) |
| ***B65H 7/16*** | (2006.01) |

(52) U.S. Cl.
CPC ..... *B65H 7/14* (2013.01); *B65H 7/16* (2013.01); *B65H 2511/51* (2013.01); *B65H 2515/342* (2013.01); *B65H 2553/42* (2013.01)

(58) Field of Classification Search
USPC ..... 271/94, 96, 97, 98, 31, 108
See application file for complete search history.

(56) References Cited

U.S. PATENT DOCUMENTS

| | | | | |
|---|---|---|---|---|
| 6,182,962 | B1 * | 2/2001 | Leuthold | 271/152 |
| 7,537,208 | B2 * | 5/2009 | Fukusaka et al. | 271/96 |
| 7,850,162 | B2 * | 12/2010 | Imai et al. | 271/31 |
| 8,210,518 | B2 * | 7/2012 | Suzuki | 271/97 |
| 8,622,380 | B2 * | 1/2014 | Yamazaki et al. | 271/97 |

FOREIGN PATENT DOCUMENTS

| | | | |
|---|---|---|---|
| JP | H11-079441 | A | 3/1999 |
| JP | 2010-254462 | | 11/2010 |
| JP | 2010-254462 | A | 11/2010 |
| JP | 2011-174777 | A | 9/2011 |

OTHER PUBLICATIONS

First Office Action issued in corresponding Chinese Patent Application No. 201410337950.3, dated Jan. 5, 2016, with English translation (25 pages).
Office Action issued by the Japan Patent Office on Apr. 28, 2015 in corresponding Japanese Application No. 2013-148237, and English language translation of Office Action (11 pages).

* cited by examiner

SHEET FEEDING DEVICE, SHEET FEEDING METHOD, AND IMAGE FORMING APPARATUS

This application is based on Japanese Patent Application No. 2013-148237 filed on Jul. 17, 2013, the content of which is incorporated herein by reference.

BACKGROUND OF THE INVENTION

1. Field of the Invention

The present invention relates to a sheet feeding device and method for pneumatically floating sheets to be picked up one by one from a sheet stack and feeding the sheets into a transportation path, and the invention also relates to an image forming apparatus including the sheet feeding device.

2. Description of Related Art

As an invention relevant to a conventional sheet feeding device, for example, a sheet feeding device described in Japanese Patent Laid-Open Publication No. 2010-254462 is known. FIG. 15 is a configuration diagram of the sheet feeding device 100 described in Japanese Patent Laid-Open Publication No. 2010-254462.

The sheet feeding device 100 includes a blowing unit 102 that blows floating air onto the top edge of a stack of sheets Se (on the positive side in the z-axis direction), thereby floating the top sheet S1. Endless suction belts 104 with a number of through-holes provided therein are positioned above the stack of sheets Se. By means of an internal fan provided in a chamber (not shown) positioned inside relative to the suction belts 104, the top sheet is attracted to the suction belts 104 by drawing air between the stack of sheets Se and the suction belts 104 into the chamber via the through-holes. The suction belts 104 are rotated by a drive force from a motor (not shown). Accordingly, the attracted sheet is carried in the x-axis direction to a receiving port 108 of a transportation path 106. Thereafter, the top sheet S1 is carried through the transportation path 106 to an imaging unit (not shown).

The sheet feeding device 100 further includes an image pickup unit 110 and a control circuit 112. The image pickup unit 110 captures images of the floated top sheet S1 and another sheet immediately therebelow, from a predetermined distance in the y-axis direction relative to one side P1 of the stack of sheets Se. The control circuit 112 calculates the gap between the sheets on the basis of the images captured by the image pickup unit 110. Moreover, the control circuit 112 adjusts the volume of air from the blowing unit 102 on the basis of the calculated gap between the sheets.

Incidentally, the sheet feeding device 100 has difficulty in reliably separating the sheet S1 from the sheet immediately therebelow. More specifically, to separate the sheet S1 from the sheet immediately therebelow, the sheet feeding device 100 blows separation air between the sheets.

However, when the sheet S1 and the sheet immediately therebelow are in close contact with each other while being attracted to the suction belts 104, there is no gap between the sheets. Accordingly, the sheet feeding device 100 might not be able to separate the sheet S1 from the sheet immediately therebelow by blowing separation air to the sheets.

SUMMARY OF THE INVENTION

A sheet feeding device according to one aspect of the present invention includes a mounting portion allowing a stack of sheets to be mounted in a top-bottom direction, a suction/transportation portion provided above the mounting portion for attracting a first sheet positioned on top of the stack, and a blowing portion for blowing air to a foremost edge of the first sheet in a transportation direction while the first sheet is being attracted by the suction/transportation portion, thereby separating the first sheet from a second sheet next to the first sheet. After the first sheet is separated from the second sheet, the suction/transportation portion transports the first sheet in the transportation direction. The suction/transportation portion sets a suction force applied to the foremost edge of the first sheet smaller when the blowing portion blows air to the first sheet than when the suction/transportation portion transports the first sheet. The present invention is also directed to a sheet feeding method for the sheet feeding device.

DETAILED DESCRIPTION OF THE PREFERRED EMBODIMENTS

Embodiment

Figure 1:
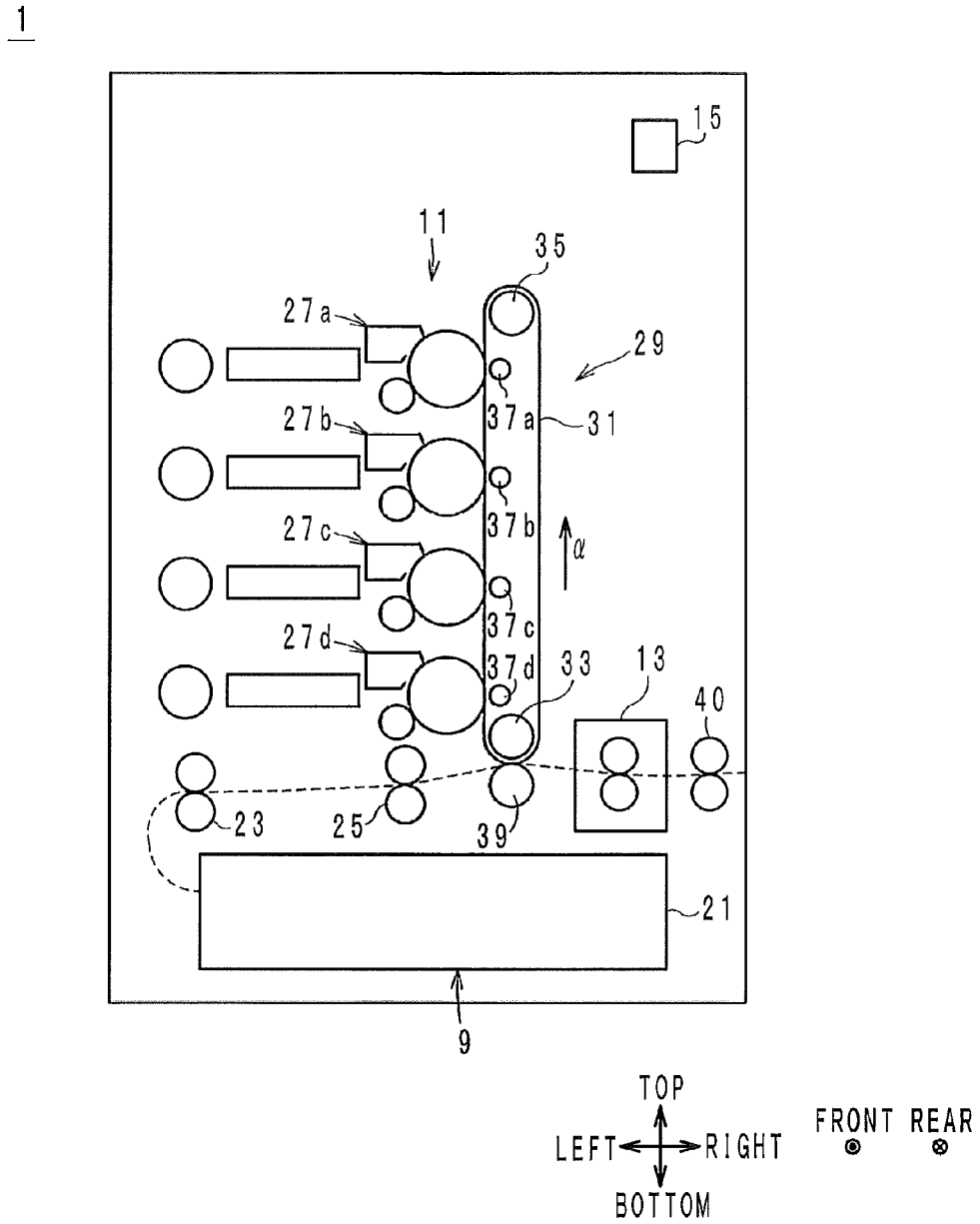
FIG. 1 is a configuration diagram of an image forming apparatus including a sheet feeding device according to an embodiment.

Hereinafter, a sheet feeding device according to an embodiment of the present invention and an image forming apparatus including the same will be described in detail with reference to the drawings.

Preliminary Notes

First, directions in the figures will be defined. For convenience of explanation, the terms "right-left", "front-back", and "top-bottom" directions as used in the present embodiment correspond to the "right-left", "front-back", and "top-bottom" directions, respectively, of the sheet of FIG. 1.

Moreover, some components in the figures have the suffix a, b, c, or d added to the right of their reference numerals. The suffixes a, b, c, and d refer to yellow (Y), magenta (M), cyan (C), and black (Bk), respectively. For example, an imaging portion 27*a* means an imaging portion 27 for yellow. In addition, reference numerals without suffixes mean any of the colors Y, M, C, and Bk. For example, an imaging portion 27 means an imaging portion for any one of the colors Y, M, C, and Bk.

Configuration and Operation of Image Forming Apparatus

FIG. 1 is a configuration diagram of an image forming apparatus 1 including a sheet feeding device 21 according to an embodiment.

The image forming apparatus 1 is, for example, a digital commercial printer, and includes a sheet feeding unit 9, an imaging unit 11, a fusing unit 13, a control circuit 15, and an ejection roller pair 40.

The sheet feeding unit 9 generally includes a sheet feeding device 21, a feed roller pair 23, and a registration roller pair 25. The sheet feeding device 21 (to be described in detail later) accommodates a plurality of sheets (e.g., paper) placed therein as a stack of sheets Se. The sheet feeding device 21 (to be described in detail later) pneumatically floats the top sheet to be picked up from the stack of sheets Se, and feeds the sheet into a transportation path. The fed sheet is transported downstream by the feed roller pair 23 being rotated. Thereafter, the sheet contacts the registration roller pair 25 at rest, and stops there temporarily. The registration roller pair 25 is rotated by a drive force from a motor (not shown) under timing control by a CPU in the control circuit 15. As a result, the sheet is fed from the registration roller pair 25 to a secondary transfer region to be described layer, with such timing that a composite toner image formed on an intermediate transfer belt 31 to be described later can be transferred onto a predetermined area of the sheet.

The imaging unit 11 forms an image by means of electrophotography. In the present embodiment, the imaging unit 11 forms a full-color image. To this end, the imaging unit 11 has a tandem configuration. More specifically, the imaging unit 11 includes imaging portions 27*a* to 27*d*, for example, for Y, M, C, and Bk, as well as a transfer unit 29.

Each of the imaging portions 27*a* to 27*d* includes a photoreceptor drum attached so as to be rotatable. There are a charging unit, an exposing unit, a developing unit, and a cleaning unit provided around the photoreceptor drum.

The charging unit charges the circumferential surface of the photoreceptor drum for its corresponding color.

The exposing unit receives image data for the corresponding color. Here, the image data is transmitted to the CPU in the control circuit 15 from a personal computer connected to the image forming apparatus 1. The CPU generates image data for each of the colors Y, M. C, and Bk, on the basis of received image data, and outputs the generated data to the exposing unit corresponding to the color. The exposing unit generates an optical beam modulated with the image data for the corresponding color, and scans line by line the circumferential surface of the photoreceptor drum being charged. At this time, the photoreceptor drum is rotating, and therefore, an electrostatic latent image in the corresponding color is formed on the circumferential surface.

The developing unit develops the electrostatic latent image formed on the photoreceptor drum for the corresponding color, by toner, thereby forming a toner image in the color on the circumference surface of the photoreceptor drum.

The transfer unit 29 generally includes an intermediate transfer belt 31 in an endless form, a drive roller 33, a plurality of driven rollers 35, primary transfer rollers 37*a* to 37*d*, and a secondary transfer roller 39.

The intermediate transfer belt 31 is stretched around the drive roller 33 and the driven rollers 35. The drive roller 33 is rotated by a drive force provided by an unillustrated motor. The driven rollers 35 are rotated following the rotation of the drive roller 33. As a result, the intermediate transfer belt 31 rotates counterclockwise (as indicated by arrow a).

The primary transfer rollers 37 have transfer voltages applied thereto. There are electric fields generated between the primary transfer rollers 37 and the photoreceptor drums for their corresponding colors. By the action of the electric fields, the toner images supported on the photoreceptor drums are transferred sequentially onto the same area of the intermediate transfer belt 31 (primary transfer). Accordingly, the toner images in the respective colors overlap with one another on the intermediate transfer belt 31, resulting in a composite toner image. The composite toner image is carried toward the secondary transfer roller 39 through rotation of the intermediate transfer belt 31.

The secondary transfer roller 39 is in contact with the intermediate transfer belt 31, forming a secondary transfer region therebetween. A sheet fed from the registration roller pair 25 is introduced into the secondary transfer region. The secondary transfer roller 39 has a transfer voltage applied thereto, and therefore, an electric field is formed between the secondary transfer roller 39 and the intermediate transfer belt 31. By the action of the electric field, the sheet passing through the secondary transfer region is subjected to secondary transfer of the composite toner image from the intermediate transfer belt 31. Thereafter, the sheet subjected to the secondary transfer is fed further downward in the transportation path by the secondary transfer roller 39 and the intermediate transfer belt 31.

Incidentally, the toner that is left untransferred onto the intermediate transfer belt 31 after primary transfer remains on the circumferential surface of each photoreceptor drum as untransferred toner. The cleaning unit in each imaging portion 27 collects untransferred toner by scraping it off the circumferential surface of the photoreceptor drum for the corresponding color.

Furthermore, the toner that is left untransferred after secondary transfer remains on the surface of the intermediate transfer belt 31 as untransferred toner. An unillustrated cleaning unit collects untransferred toner by scraping it off the intermediate transfer belt 31.

The fusing unit 13 includes a heating roller and a pressure roller between which a fusing nip is formed. The sheet from the secondary transfer region is introduced to the fusing nip. The sheet is heated and pressed when it is passed through the fusing nip by rotation of the rollers. As a result, the composite toner image is fixed on the sheet. Thereafter, the fusing unit 13 feeds the sheet toward the ejection roller pair 40 provided downstream in the transportation path.

Once the sheet subjected to the fusing processing is introduced from the fusing unit 13, the ejection roller pair 40 ejects the sheet into an output tray outside the main unit.

Note that the process for forming a full-color image has been described above; to form a black-and-white image, only the features required for Bk, including the imaging portion 27*d*, are typically driven.

The control circuit 15 includes at least flash memory, the CPU, and main memory. The CPU executes a program, which is stored in, for example, the flash memory, in the main memory to control various components.

Configuration and Operation of Sheet Feeding Device

Figure 2:
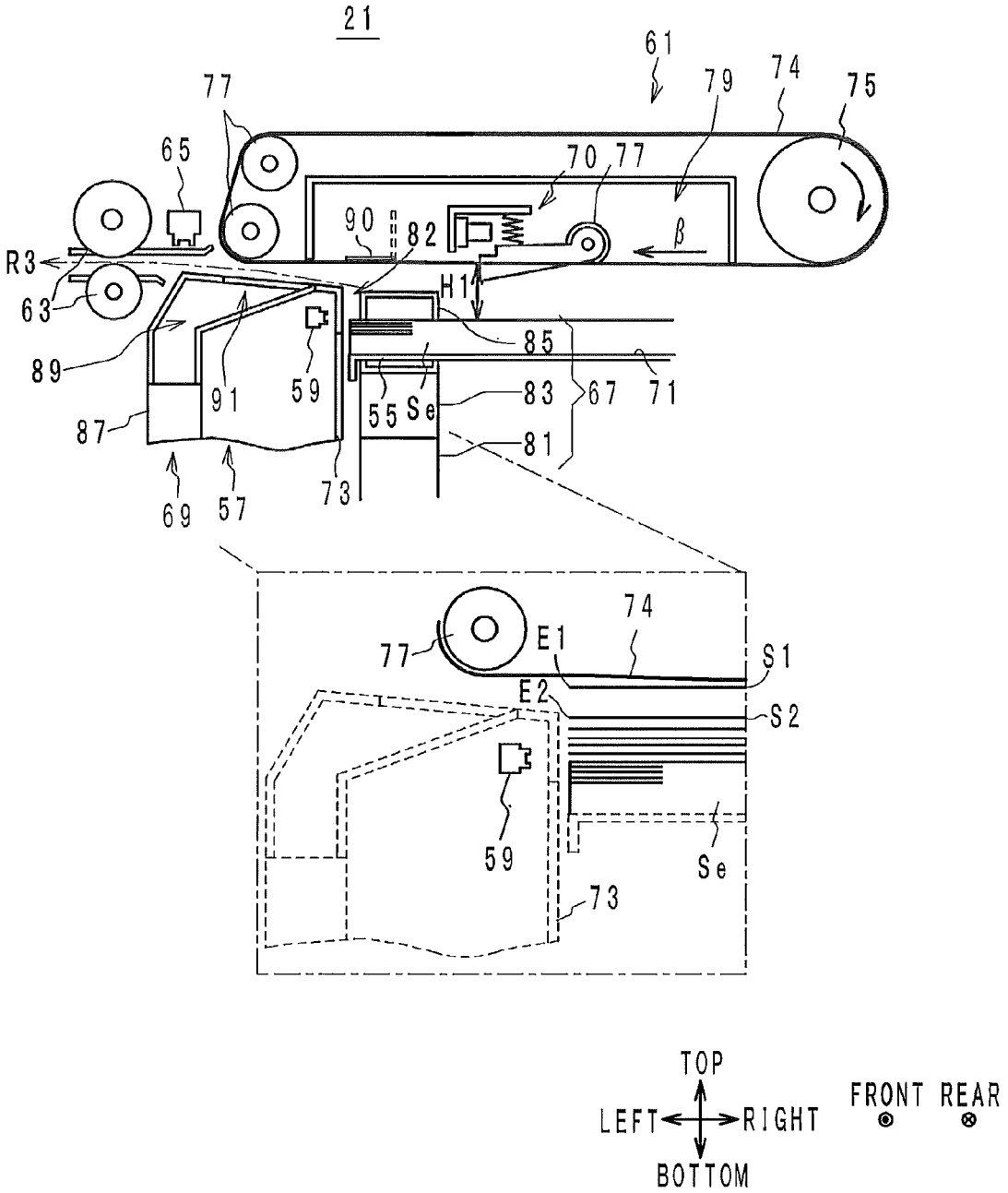
FIG. 2 is a cross-sectional structure view of the sheet feeding device.
Figure 3:
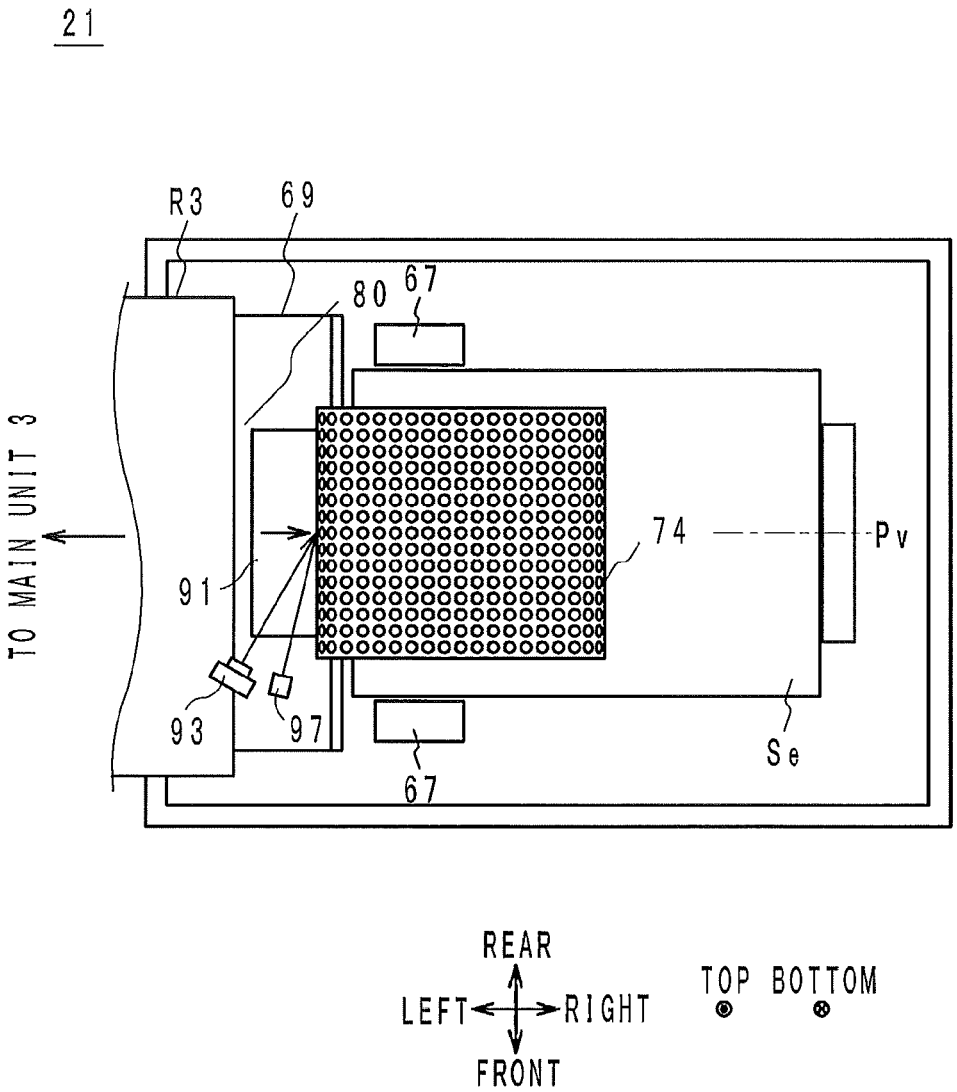
FIG. 3 is a top view of the sheet feeding device.
Figure 4:
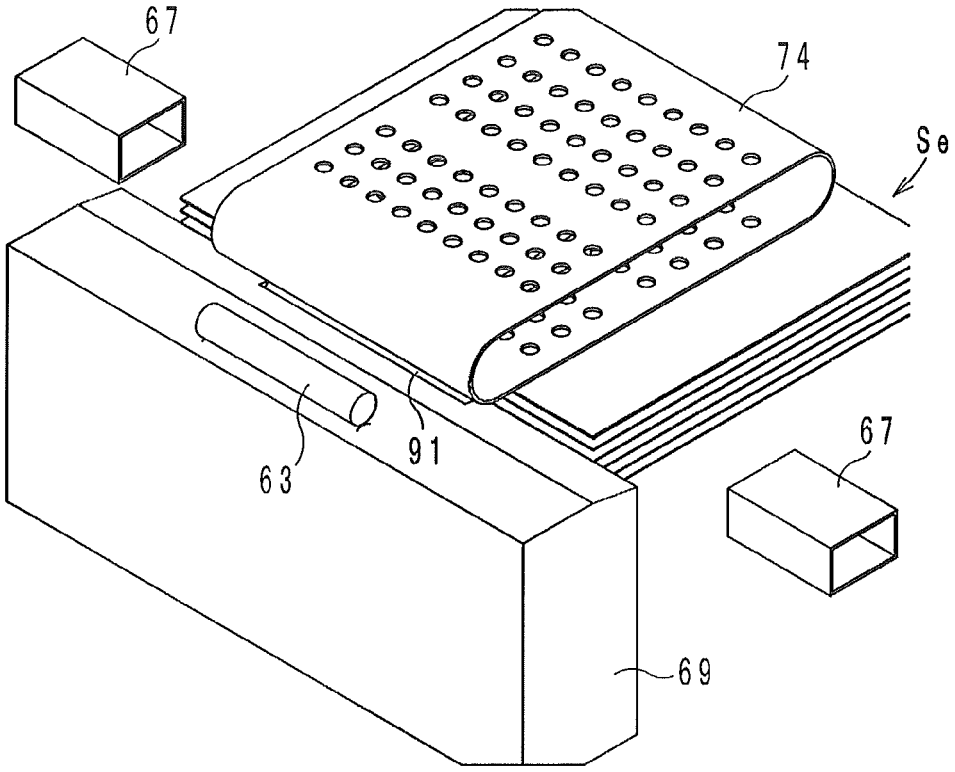
FIG. 4 is an external oblique view of the sheet feeding device.

Next, the configuration of the sheet feeding device 21 will be described with reference to the drawings. FIG. 2 is a cross-sectional structure view of the sheet feeding device 21. FIG. 3 is a top view of the sheet feeding device 21. FIG. 4 is an external oblique view of the sheet feeding device 21. In the following, the top sheet of a sheet stack Se will be referred to as a sheet S1, and the next sheet will be referred to as a sheet S2. Furthermore, the foremost edge of the sheet S1 (the left-hand side of the sheet, which is parallel to the front-back direction) will be referred to as a foremost edge E1, and the foremost edge of the sheet S2 (the left-hand side of the sheet, which is parallel to the front-back direction) will be referred to as a foremost edge E2.

The sheet feeding device 21 includes an elevating plate 55, an abutting portion 57, a limit sensor 59, a suction/transportation mechanism 61, a transportation roller pair 63, a feed sensor 65, first blowing mechanisms 67, a second blowing mechanism 69, a suction sensor 70, an image pickup portion 93, and a light source 97. Moreover, the control circuit 15 also functions as a control portion for the sheet feeding device 21.

The elevating plate 55 has a rectangular mounting portion 71 approximately parallel to the horizontal plane. The direction normal to the mounting portion 71 will be referred to below as the direction of stacking. The mounting portion 71 allows a plurality of sheets to be placed in the direction of stacking (top-bottom direction) thereon as a stack of sheets Se. The elevating plate 55 is configured so as to be movable up and down, i.e., elevatable, along the direction of stacking between predetermined lower and upper limit positions. As for the mechanism of elevation, a well-known technology can be applied, and therefore, any description thereof will be omitted.

The abutting portion 57 has an abutting face 73. The abutting face 73 extends in a direction parallel to the direction of stacking, from a position along one of the four sides of the mounting portion 71 that is located on the left. The abutting face 73 contacts one of the four side surfaces of the stack of sheets Se that is located on the left (i.e., the left-side surface of the stack). Note that each sheet is fed into a transportation path R3 from the left of the two sides that are parallel to the front-back direction.

Note that the following are provided around the mounting portion 71, but they are not essential to the present invention, and therefore, the details thereof will not be described: a pair of regulating plates that regulate the position of the stack of sheets Se in the front-back direction; and a regulating plate that regulates the position of the right-side surface of the stack of sheets Se in the right-left direction such that the left-side surface of the stack contacts the abutting face 73.

The limit sensor 59 is typically an active optical sensor fixed to the abutting portion 57. When the top sheet S1 of the stack of sheets Se has reached a predetermined upper limit position, the limit sensor 59 outputs, for example, an electrical HI signal to the control circuit 15 (to be described later). On the other hand, when the predetermined upper limit position is not reached, an electrical LO signal is outputted.

The suction/transportation mechanism 61 is provided above the elevating plate 55 and the abutting portion 57, and specifically includes, for example, a suction belt 74, a chamber 79, a drive roller 75, a plurality of (for example, three) driven rollers 77, and a shutter 90.

The suction belt 74 is an endless belt. The suction belt 74 has a number of holes piercing from the outer surface to the inner surface. More specifically, a predetermined number of through-holes (namely, arrays of through-holes) are provided along the width direction of the suction belt 74 (i.e., the direction parallel to the front-back direction). The arrays of through-holes are provided at predetermined intervals across the entire length of the belt.

The chamber 79 is positioned within the inner circumference of the suction belt 74, and generally includes an air inlet, a fan, and a motor. The air inlet is provided so as to face the inner surface of the suction belt 74 positioned therebelow. The fan is housed in the chamber, and is rotated by a drive force provided by the motor. Accordingly, the air inlet, the fan, and the motor collectively function as a negative pressure generation portion for generating a negative pressure within the chamber 79 (i.e., space within the inner circumference of the suction belt 74). Once a negative pressure is generated within the chamber 79, air between the suction belt 74 and the sheet stack Se is taken into the chamber 79 from the through-holes in the suction belt 74, so that the top sheet S1 being floated by the first blowing mechanisms 67, etc., as will be described later, is attracted to the bottom surface (i.e., the suction surface) of the suction belt 74. The air taken into the chamber 79 will be referred to below as "suction air".

The drive roller 75, when viewed in, for example, a front view, is positioned above the center of the stack of sheets Se in the right-left direction. Moreover, two of the three driven rollers 77 are arranged side by side approximately in the top-bottom direction above the second blowing mechanism 69. These rollers 77 are located in a position offset leftward from the abutting face 73 in the right-left direction. In addition, the remaining driven roller 77 (also referred to below as the intermediate driven roller) is positioned between the lower driven roller 77 (also referred to below as the left driven roller) and the drive roller 75.

Each of the rollers 75 and 77 has a rotation axis approximately parallel to the front-back direction. The drive roller 75 is rotationally driven by a drive force from an unillustrated motor. Once the drive roller 75 starts rotating, each of the driven rollers 77 is rotated correspondingly.

The suction belt 74 is stretched around the rollers 75 and 77, so as to be positioned side by side in the front-back direction. More specifically, the drive roller 75 and the intermediate driven roller 77 are arranged with their bottoms approximately at the same position in the top-bottom direction. Moreover, the intermediate driven roller 77 and the left driven roller 77 are arranged such that the bottom position of the left driven roller 77 is slightly higher than the bottom position of the intermediate driven roller 77. As a result, the suction belt 74 is positioned approximately parallel to the horizontal plane between the drive roller 75 and the intermediate driven roller 77, and inclined diagonally upward relative to the horizontal plane between the intermediate driven roller 77 and the left driven roller 77. In other words, the suction belt 74 is curved at the intermediate driven roller 77. The suction belt 74 as above rotates clockwise in accordance with the rotation of the drive roller 75. Thus, the top sheet attracted to the suction surface of the suction belt 74 is transported leftward (i.e., in the transportation direction).

FIG. 2 shows the beginning of the transportation path R3. The transportation path R3 generally consists of a plurality of guiding members. The beginning of the transportation path R3 is a sheet entrance 82. The entrance 82 is the space between the top edge of the abutting portion 57 and the bottom of the left driven roller 77.

The transportation roller pair 63 is positioned near the entrance 82 in the transportation path R3. The transportation roller pair 63 is rotated by a drive force provided by a motor (not shown) to receive a sheet introduced therebetween and feed it downstream in the transportation path R3.

Here, the feed sensor 65 is typically an active optical sensor provided between the entrance 82 and the transportation roller pair 63 in the transportation path R3. The feed sensor 65 outputs an electrical HI or LO signal to the control circuit 15 in order to specify whether or not a sheet has passed a reference position between the entrance 82 and the transportation roller pair 63.

The first blowing mechanisms 67 are provided one each on the front and back sides of the image forming apparatus 1 relative to the elevating plate 55. Each of the first blowing mechanisms 67 typically includes a fan 81, a duct 83, and an air outlet 85.

The fan 81 takes ambient air into the duct 83. In the first blowing mechanism 67 on the front side, the duct 83 has the air outlet 85 provided near the top of the stack of sheets Se so as to face the foremost side of the stack. In the first blowing mechanism 67 on the front side, air taken into the duct 83 flows through the duct 83 toward the air outlet 85, and is blown out from the air outlet 85 onto the stack of sheets Se at the upper portion of its front side.

On the other hand, the first blowing mechanism 67 on the back side is substantially symmetrical to the one on the front side relative to the center plane Pv (see FIG. 3) of the mounting portion 71 in the front-back direction. Accordingly, from the air outlet 85 on the back side, air is blown out onto the stack of sheets Se at the upper portion of its back side. Here, the front and back sides specifically refer to the surfaces of the stack of sheets Se that are parallel to both the transportation direction of the top sheet and the direction of stacking.

The air blown out from both of the air outlets is directed onto the front and back sides of the stack of sheets Se. The air mainly plays the role of floating the top sheet S1 of the stack of sheets Se, and will be referred to below as "floating air".

Furthermore, the second blowing mechanism 69 is typically positioned to the left of the mounting portion 71. More specifically, the second blowing mechanism 69 is adjacent to the abutting portion 57 on the left side. The second blowing mechanism 69 typically includes a fan 87, a duct 89, and an air outlet 91.

The fan 87 takes its surrounding air into the duct 89. The duct 89 is provided so as to reach the proximity of the entrance 82 of the transportation path R3. The duct 89 has the air outlet 91 provided on its foremost edge. The air outlet 91 is positioned so as to face the space directly below the suction belt 74. The air taken into the duct 89 flows toward the air outlet 91, and is blown out from the air outlet 91 rightward. As a result, the air from the air outlet 91 is blown toward a position directly below the suction belt 74. The air mainly plays the role of separating the top sheet S1 from the sheet S2 immediately therebelow, and will be referred to below as "separation air".

The suction sensor 70 includes at least an active optical sensor and a sensing element, and, outputs an electrical HI or LO signal to the control circuit 15 in order to specify whether or not the top sheet of the stack of sheets Se is being attracted to the suction belt 74.

The shutter 90 is a plate-like member for covering the holes in the suction belt 74 that correspond to the foremost edge E1 of the top sheet S1 when the second blowing mechanism 69 blows air to the top sheet S1. The holes in the suction belt 74 that correspond to the foremost edge E1 of the top sheet S1 are the holes that are positioned directly above the foremost edge of the sheet stack Se in the transportation direction. That is, the shutter 90 is positioned directly above the foremost edge of the sheet stack Se in the transportation direction. Moreover, the shutter 90 is capable of pivoting on its right edge. The suction/transportation mechanism 61 further includes an unillustrated motor (shutter drive portion) for driving the shutter 90. The motor rotationally drives the shutter 90, thereby switching between the states of covering and not covering the holes in the suction belt 74 that correspond to the foremost edge E1 of the sheet S1. In the state where the holes in the suction belt 74 are covered, the shutter 90 is being laid horizontally, whereas in the state where the holes in the suction belt 74 are uncovered, the shutter 90 is standing upright.

The image pickup portion 93 is an image acquisition means for capturing an image of the foremost edge E1 of the floated top sheet S1, the foremost edge E2 of the next sheet S2, and their vicinities, and transmitting data for the image to the control circuit 15 (to be described later). The image pickup portion 93 is, for example, a CCD camera. The light source 97 illuminates the foremost edge E1 of the top sheet S1, the foremost edge E2 of the next sheet S2, and their vicinities, such that the image pickup portion 93 can capture an image of them.

Figure 5:
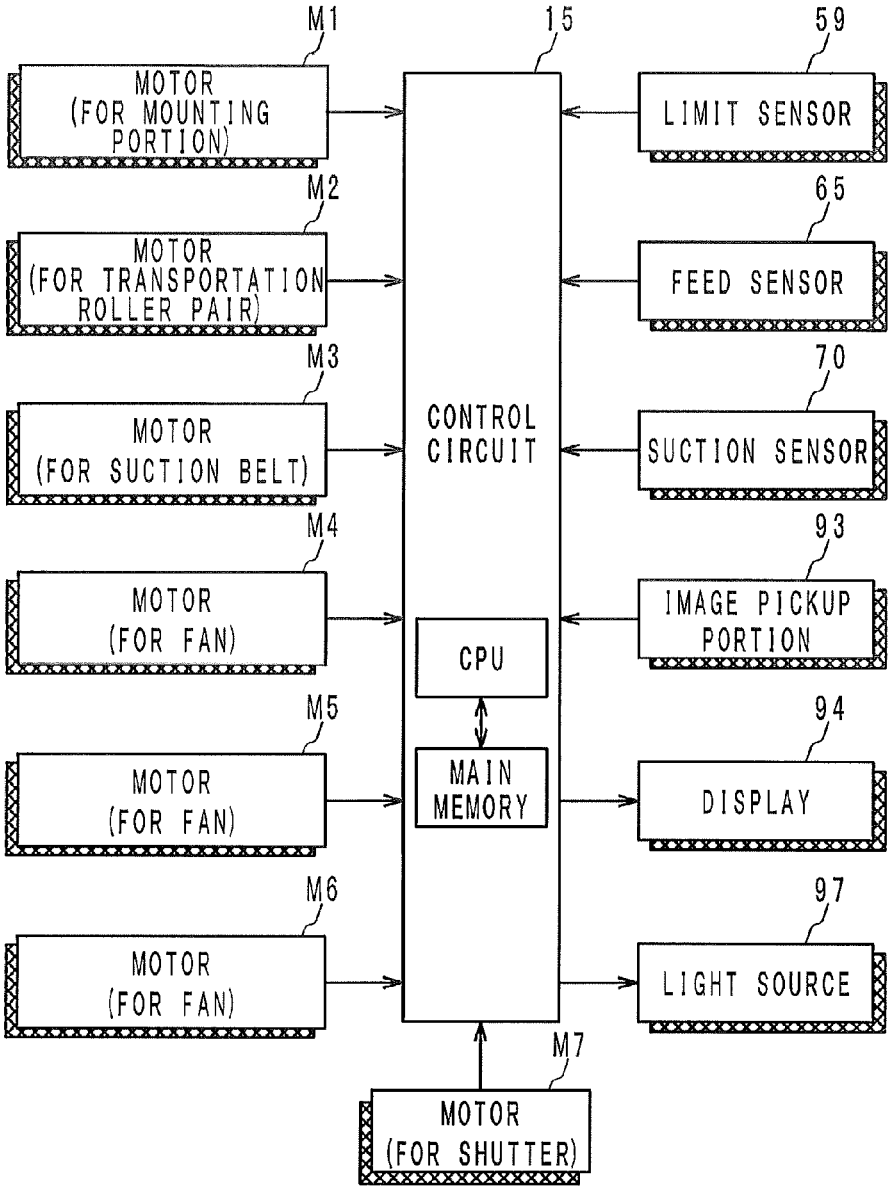
FIG. 5 is a block diagram illustrating a control system of the sheet feeding device.

Next, the control system of the sheet feeding device 21 will be described with reference to the drawings. FIG. 5 is a block diagram illustrating the control system of the sheet feeding device 21.

The sheet feeding device 21, under control of the CPU, pneumatically floats the top sheet S1 to be picked up from the stack of sheets Se, and feeds the sheet into the transportation path R3. To perform such control, various components indispensable to the sheet feeding device 21 are electrically connected to the CPU, etc., included in the control circuit 15 of the main unit 3. More specifically, the control circuit 15 is configured so as to be able to receive electrical signals from the limit sensor 59, the feed sensor 65, and the suction sensor 70. Moreover, the control circuit 15 is configured so as to be able to transmit a control signal to the light source 97. In addition, the control circuit 15 is configured so as to be able to receive image data from the image pickup portion 93.

Furthermore, the control circuit 15 is configured so as to be able to transmit control signals to a motor M1 for the mounting portion 71, a motor M2 for the transportation roller pair 63, a motor M3 for the suction belt 74, a motor M4 for the fan 81, a motor M5 for the fan 87, a motor M6 for the fan in the chamber 79, and a motor M7 for the shutter 90. Moreover, the control circuit 15 is connected to a display 94 capable of displaying various types of information. A typical example of the display 94 is a display provided in the image forming apparatus 1.

Figure 6:
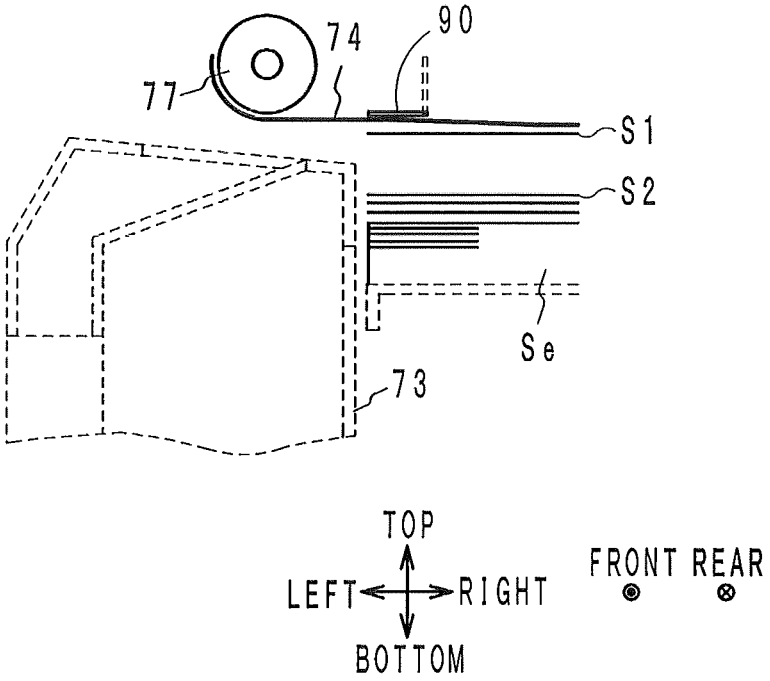
FIG. 6 is a cross-sectional structure view of the sheet feeding device where a sheet is being attracted.
Figure 7:
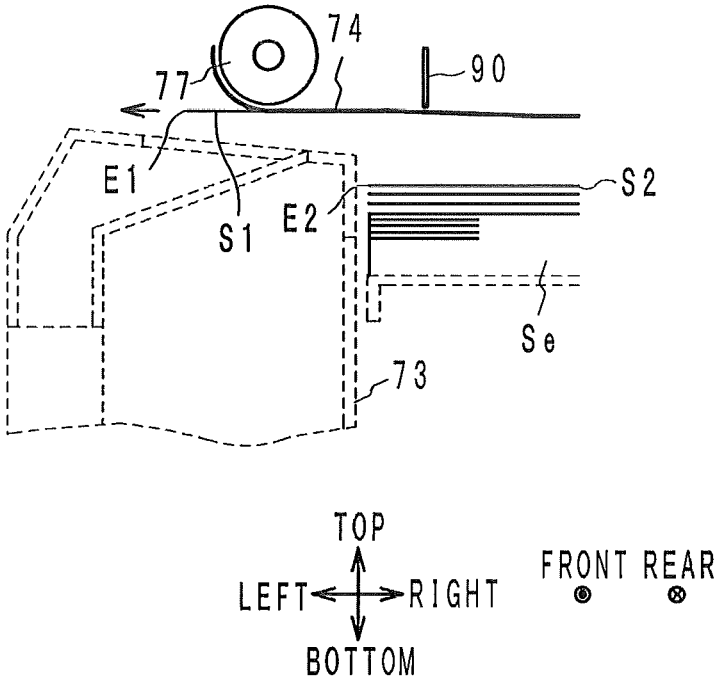
FIG. 7 is a cross-sectional structure view of the sheet feeding device where the sheet is being transported.
Figure 8:
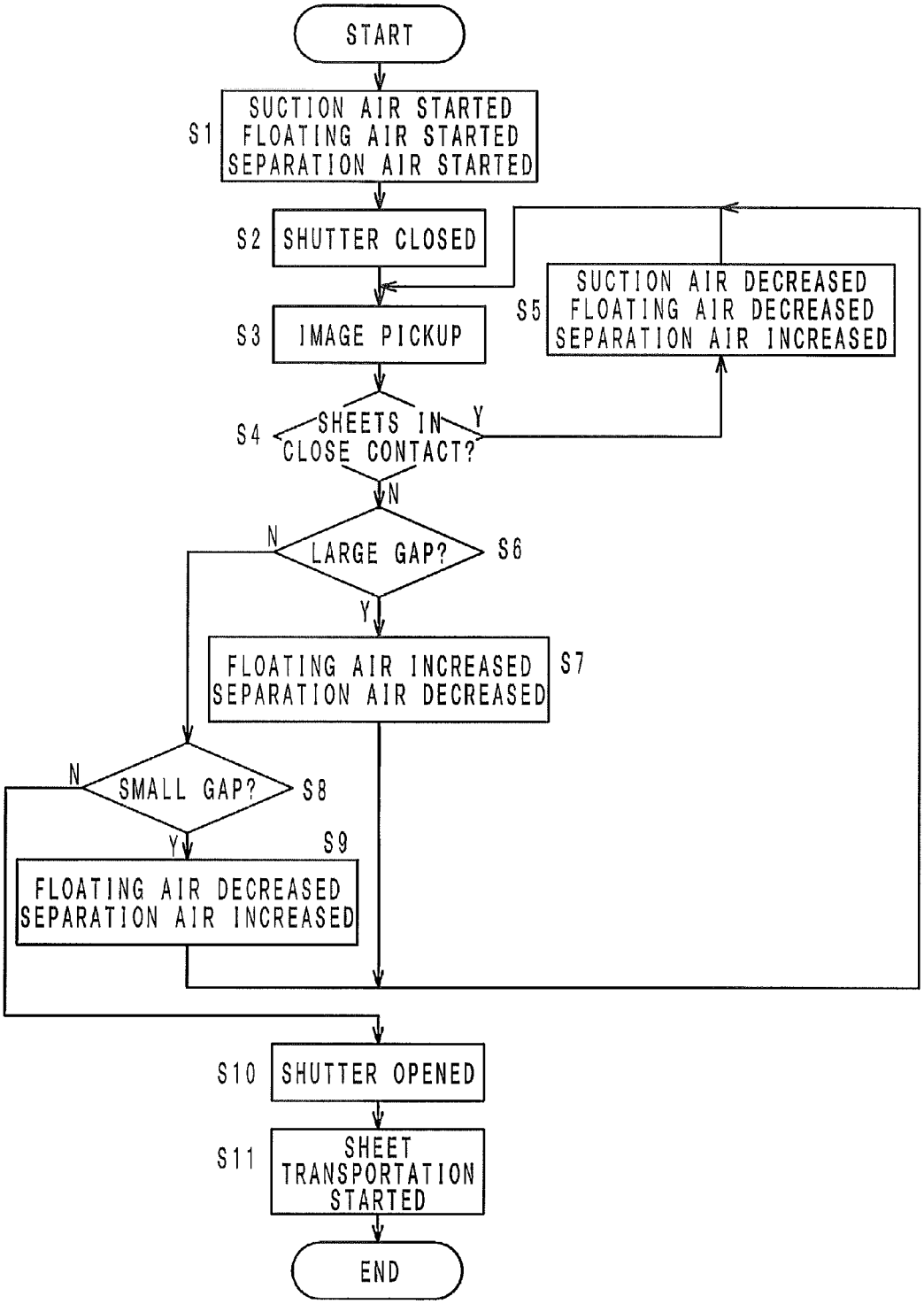
FIG. 8 is a flowchart for control performed by a control circuit in the sheet feeding device.
Figure 9:
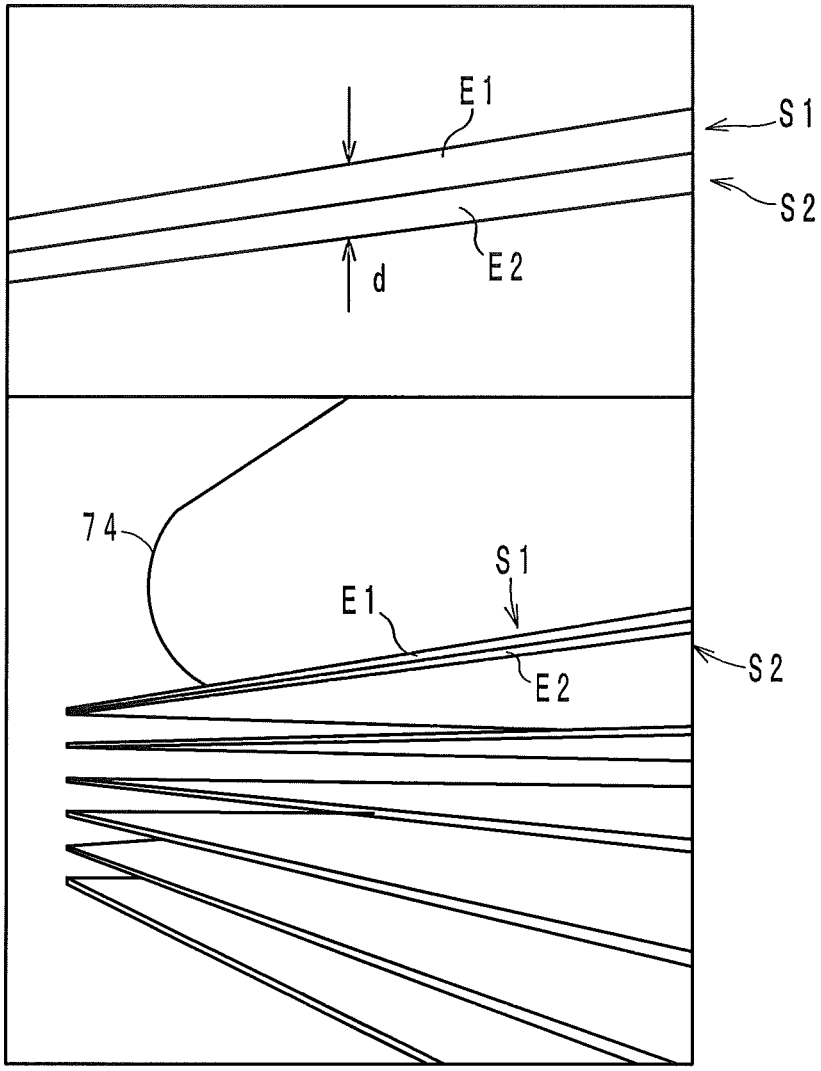
FIG. 9 depicts a combined image obtained through processing by the control circuit.

Next, the operation of the sheet feeding device 21 will be described with reference to the drawings. FIG. 6 is a cross-sectional structure view of the sheet feeding device 21 where the sheet S1 is being attracted. FIG. 7 is a cross-sectional structure view of the sheet feeding device 21 where the sheet S1 is being transported. FIG. 8 is a flowchart for control performed by the control circuit 15 in the sheet feeding device 21. FIG. 9 depicts a combined image obtained through processing by the control circuit 15.

First, the operation of the sheet feeding device 21 will be outlined with reference to FIGS. 6 and 7. The suction/transportation mechanism 61 transports the top sheet S1 in the transportation direction after the second blowing mechanism 69 separates the top sheet S1 from the next sheet S2. At this time, the suction/transportation mechanism 61 sets the suction force applied to the foremost edge E1 of the sheet S1 smaller when the second blowing mechanism 69 blows air to the sheet S1 than when the suction/transportation mechanism 61 transports the sheet S1. In the present embodiment, the suction/transportation mechanism 61 inhibits the suction force from acting on the foremost edge E1 of the sheet S1 while the second blowing mechanism 69 is blowing air to the sheet S1.

More specifically, before the suction/transportation mechanism 61 transports the sheet S1, the second blowing mechanism 69 blows separation air to both the foremost edge E1 of the sheet S1 and the foremost edge E2 of the sheet S2 in order to separate the sheet S1 from the sheet S2, as shown in FIG. 6. At this time, the control circuit 15 causes the motor M7 to operate such that the shutter 90 covers the holes in the suction belt 74 that correspond to the foremost edge E1 of the sheet S1. As a result, no suction force acts on the foremost edge E1 of the sheet S1. However, since the shutter 90 is positioned in the vicinity of the foremost edge E1 of the sheet S1, the suction force applied in the area not covered by the shutter 90 is larger than the suction force applied in the area covered by the shutter 90.

Furthermore, once the sheet S1 is separated from the sheet S2, the suction/transportation mechanism 61 starts transporting the sheet S1, as shown in FIG. 7. At this time, the control circuit 15 causes the motor M7 to operate such that the shutter 90 uncovers the holes in the suction belt 74 that correspond to the foremost edge E1 of the sheet S1. This will be described in more detail below with reference to FIG. 8.

First, the control circuit 15 causes the first blowing mechanisms 67 to start the blowing of floating air, causes the second blowing mechanism 69 to start the blowing of separation air, and causes the suction/transportation mechanism 61 to start the drawing of suction air (step S1). More specifically, the control circuit 15 has some information prestored in its flash memory or suchlike, regarding the size and grammage of sheet (i.e., the type of sheet), and the initial value for the amount of air suitable for the type of sheet. To achieve the initial value, the control circuit 15 adjusts the amount of floating air blown out from each of the first blowing mechanisms 67 and/or the amount of separation air blown out from the second blowing mechanism 69 by controlling the rotation of the motors M4 and M5. The control circuit 15 also controls the rotation of the motor M6 in the chamber 79.

Next, the control circuit 15 causes the motor M7 to operate such that the shutter 90 covers the holes in the suction belt 74 that correspond to the foremost edge E1 of the sheet S1 (step S2).

Next, the control circuit 15 causes the image pickup portion 93 to capture an image of the foremost edge E1 of the top sheet S1, the foremost edge E2 of the next sheet S2, and their vicinities while the second blowing mechanism 69 is blowing separation air to the foremost edge E1 of the sheet S1 (step S3). The control circuit 15 performs image processing on image data acquired from the image pickup portion 93. FIG. 9 shows two images in combination. The lower part of FIG. 9 is an image captured by the image pickup portion 93. The upper part of FIG. 9 is a magnified image of the foremost edge E1 of the sheet S1 and the foremost edge E2 of the sheet S2 (simply referred to below as a magnified image). On the basis of image data acquired from the image pickup portion 93, the control circuit 15 generates a magnified image as shown in the upper part of FIG. 9, and combines the magnified image with an image as shown in the lower part of FIG. 9.

Next, the control circuit 15 determines whether or not the sheets S1 and S2 are in close contact (step S3). More specifically, the control circuit 15 measures the thickness d of the sheet attracted to the suction belt 74 on the basis of the magnified image as shown in in the upper part of FIG. 9. Further, the control circuit 15 determines whether the thickness d is greater than a predetermined value or not. The predetermined value corresponds to the thickness of a sheet. When the thickness d is greater than the predetermined value, so that the sheets S1 and S2 are determined to be in close contact, the process advances to step S5. On the other hand, when the thickness d does not exceed the predetermined value, so that the sheets S1 and S2 are not determined to be in close contact, the process advances to step S4.

When the sheets S1 and S2 are in close contact, the suction/transportation mechanism 61 is not able to transport the sheets. Therefore, the control circuit 15 sets the rotational speed of the motor M6 lower than an initial setting value stored in the main memory, thereby reducing the suction air to be drawn through the suction belt 74. In addition, the control circuit 15 sets the rotational speed of the motor M4 lower than an initial setting value stored in the main memory, thereby reducing the amount of floating air blown out from the fan 81. Further, the control circuit 15 sets the rotational speed of the motor M5 greater than an initial setting value stored in the main memory, thereby increasing the amount of separation air blown out from the fan 87 (step S5). Thereafter, the process advances to step S3. In this manner, steps S2 to S5 of the process are repeated until the sheets S1 and S2 are brought out of close contact.

When the sheets S1 and S2 are not in close contact, the control circuit 15 determines whether or not a calculated value Δ1 for the gap between the sheets S1 and S2 is greater than the upper limit of a normal range (step S6). In this process, the control circuit 15 calculates the temporal integral or average value (also referred to below as the calculated value Δ1) of the gap between the foremost edge E1 of the sheet S1 and the foremost edge E2 of the sheet S2 in the top-bottom direction. More specifically, the control circuit 15 calculates the temporal integral or average value (the calculated value Δ1) on the basis of results obtained by calculating the gap between the foremost edge E1 of the sheet S1 and the foremost edge E2 of the sheet S2 in the top-bottom direction over a predetermined period of time. Note that the method for calculating the temporal integral or average value is as described in Japanese Patent Laid-Open Publication No. 2010-254462, and therefore, any description thereof will be omitted. Moreover, the normal range of the gap between the foremost edge E1 of the sheet S1 and the foremost edge E2 of the sheet S2 in the top-bottom direction is the range within which any problem such as a jam is not expected to occur when the sheet S1 is being transported. In the present process, the control circuit 15 determines whether or not the sheets S1 and S2 are excessively distant from each other. When the calculated value Δ1 is greater than the upper limit of the normal range, the process advances to step S7. On the other hand, when the calculated value Δ1 is within the upper limit of the normal range, the process advances to step S8.

When the calculated value Δ1 is greater than the upper limit of the normal range, the control circuit 15 sets the rotational speed of the motor M4 greater than the initial setting value stored in the main memory, thereby increasing the amount of floating air blown out from the fan 81. In addition, the control circuit 15 sets the rotational speed of the motor M5 lower than the initial setting value stored in the main memory, thereby reducing the amount of separation air blown out from the fan 87. Thereafter, the process advances to step S3.

When the calculated value Δ1 is within the upper limit of the normal range, the control circuit 15 determines whether or not the calculated value Δ1 is less than the lower limit of the normal range (step S8). In the present process, the control circuit 15 determines whether the sheets S1 and S2 are excessively close to each other. In steps S6 and S8, the control circuit 15 determines whether the calculated value Δ1 is within the normal range or not. When the calculated value Δ1 is less than the lower limit of the normal range, the process advances to step S9. Alternatively, when the calculated value Δ1 is greater than or equal to the lower limit of the normal range, the control circuit 15 determines that the calculated value Δ1 is within the normal range, and therefore, maintains the rotational speeds of the motors M4, M5, and M6 at their initial setting values, so that the amount of floating air, the amount of separation air, and the amount of suction air do not change. Thereafter, the process advances to step S10.

When the calculated value Δ1 is less than the lower limit of the normal range, the control circuit 15 sets the rotational speed of the motor M4 lower than the initial setting value stored in the main memory, thereby reducing the amount of floating air blown out from the fan 81. Moreover, the control circuit 15 sets the rotational speed of the motor M5 higher than the initial setting value stored in the main memory, thereby increasing the amount of separation air blown out from the fan 87. Thereafter, the process advances to step S3. In this manner, steps S6 to S9 of the process are repeated until the gap between the sheets S1 and S2 falls within the normal range.

In step S10, the control circuit 15 causes the motor M7 to operate such that the shutter 90 uncovers the holes in the suction belt 74 that correspond to the foremost edge E1 of the sheet S1 (step S10). As a result, the foremost edge E1 of the sheet S1 is attracted to the suction belt 74. Thereafter, the control circuit 15 causes the motor M3 to rotate the suction belt 74, thereby transporting the sheet S1 leftward (step SM.

Effects

The sheet feeding device 21 thus configured can more reliably separate the sheet S1 from the sheet S2. More specifically, the suction/transportation mechanism 61 sets the suction force applied to the foremost edge E1 of the sheet S1 smaller when the second blowing mechanism 69 blows separation air to the sheet S1 than when the suction/transportation mechanism 61 transports the sheet S1. As a result, a gap can be readily formed between the foremost edge E1 of the sheet S1 and the foremost edge E2 of the sheet S2. Therefore, when the second blowing mechanism 69 blows separation air to the sheet S1, the air flows into the space between the foremost edge E1 of the sheet S1 and the foremost edge E2 of the sheet S2. Thus, the sheet feeding device 21 can reliably separate the sheet S1 from the sheet S2.

Furthermore, since the sheet feeding device 21 reliably separates the sheet S1 from the sheet S2, as described above, the foremost edge E1 of the sheet S1 and the foremost edge E2 of the sheet S2 are captured in an image of them having been separated. Thus, the control circuit 15 can accurately measure the gap between the sheets S1 and S2 on the basis of the image captured by the image pickup portion 93.

Furthermore, the sheet feeding device 21 allows the suction/transportation mechanism 61 to set the suction force applied to the foremost edge E1 of the sheet S1 smaller when the second blowing mechanism 69 blows separation air to the sheet S1 than when the suction/transportation mechanism 61 transports the sheet S1. As a result, the foremost edge E1 of the sheet S1 and the foremost edge E2 of the sheet S2 are prevented from sagging when the image pickup portion 93 captures an image of the foremost edge E1 of the sheet S1, the foremost edge E2 of the sheet S2, and their vicinities. Therefore, the image pickup portion 93, which is positioned below the suction/transportation mechanism 61, can readily captures an image of the foremost edge E1 of the sheet S1, the foremost edge E2 of the sheet S2, and their vicinities. Thus, the control circuit 15 can readily determine whether or not the sheets S1 and S2 are in close contact on the basis of a magnified image obtained by the image pickup portion 93. Further, the control circuit 15 can also determine, for example, the number of sheets closely contacting the sheet S1 on the basis of the magnified image.

Note that when the sheet S1 is transported, the suction force applied to the foremost edge E1 of the sheet S1 is increased. Thus, the sheet feeding device 21 can inhibit the sheet S1 from being jammed in the transportation path R3.

First Modification

Figure 10:
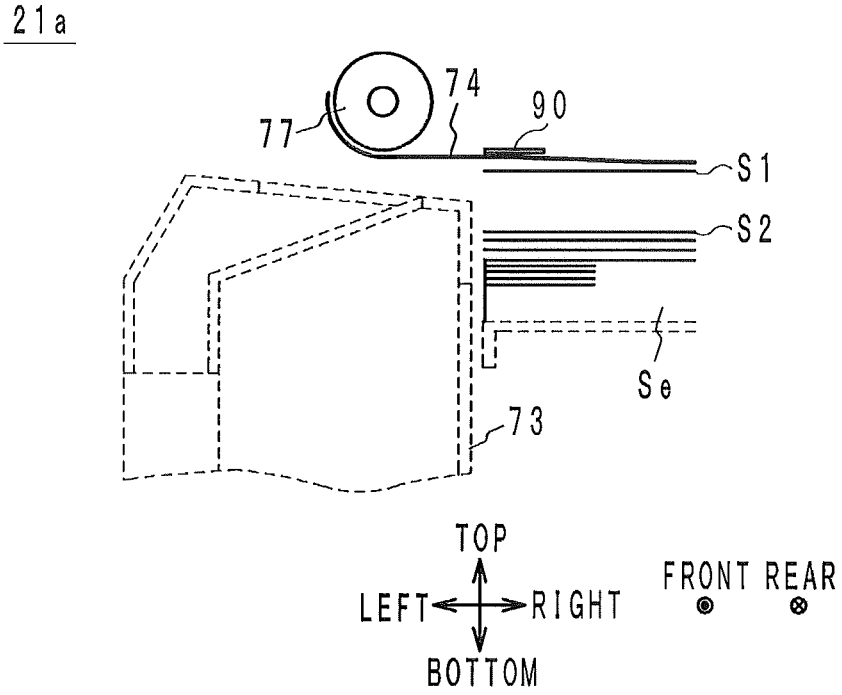
FIG. 10 is a cross-sectional structure view of a sheet feeding device according to a first modification.
Figure 11:
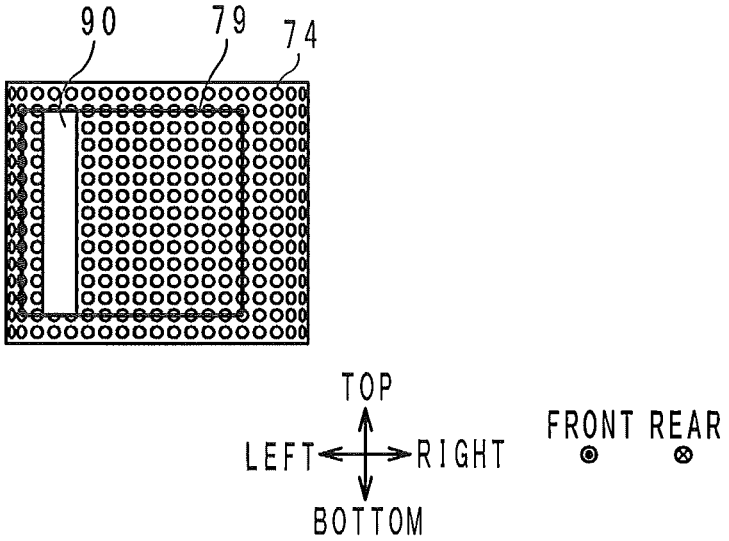
FIG. 11 is a top view of a suction belt, a chamber, and a shutter in the sheet feeding device of FIG. 10.

Hereinafter, a sheet feeding device according to a first modification will be described with reference to the drawings. FIG. 10 is a cross-sectional structure view of the sheet feeding device 21*a* according to the first modification. FIG. 11 is a top view of a suction belt 74, a chamber 79, and a shutter 90 in the sheet feeding device 21*a* of FIG. 10.

The sheet feeding device 21*a* differs from the sheet feeding device 21 in the structure of the shutter 90. More specifically, in the sheet feeding device 21, the shutter 90 can take two positions, i.e., lying and standing. On the other hand, in the sheet feeding device 21*a*, the shutter 90 can take only the lying position. That is, the shutter 90 always covers the holes in the suction belt 74 that correspond to the foremost edge E1 of the sheet S1.

In the sheet feeding device 21*a* as above, since the shutter 90 is provided, the suction/transportation mechanism 61 relatively weakens the suction force applied to the foremost edge E1 of the sheet S1 when the second blowing mechanism 69 blows separation air. On the other hand, once the suction/transportation mechanism 61 starts transporting the sheet S1, the foremost edge E1 of the sheet S1 passes the shutter 90. As a result, holes in the suction belt 74 face the foremost edge E1 of the sheet S1, so that the foremost edge E1 of the sheet S1 is attracted to the suction belt 74.

The sheet feeding device 21*a* thus configured can achieve the same effects as those achieved by the sheet feeding device 21. Further, the sheet feeding device 21*a* eliminates the need for the motor M7 for rotationally driving the shutter 90, resulting in reduced production cost.

Second Modification

Figure 12:
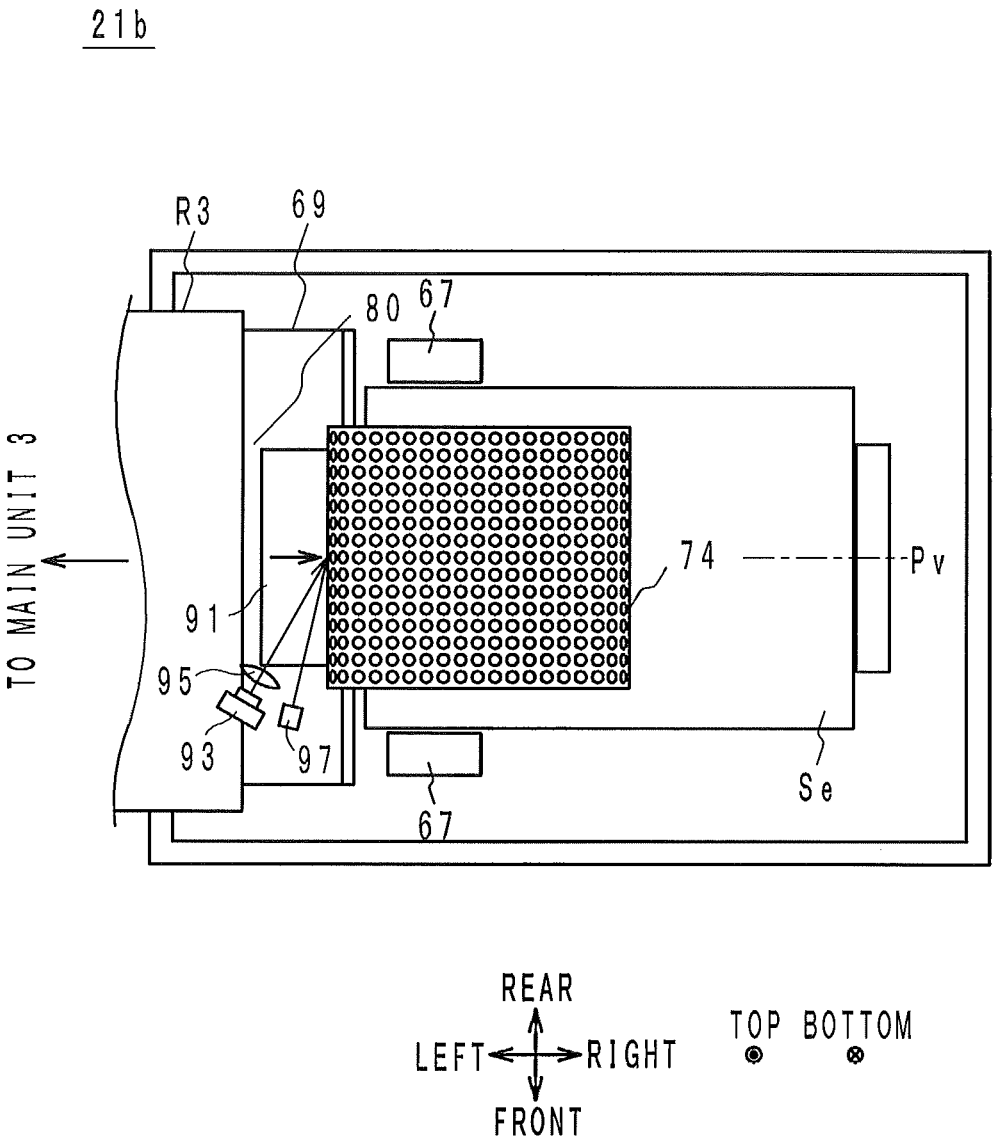
FIG. 12 is a top view of a sheet feeding device according to a second modification.
Figure 13:
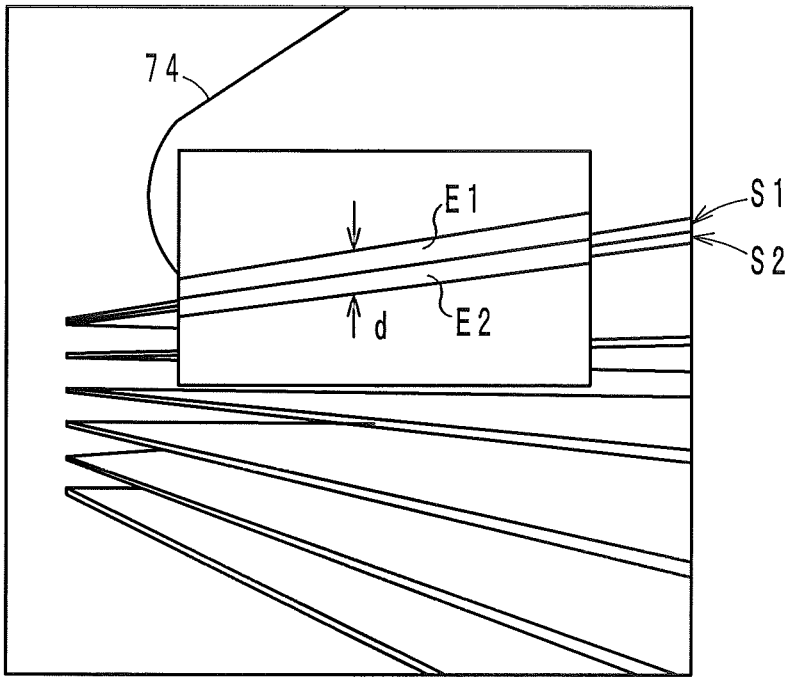
FIG. 13 is a diagram showing an image captured by an image pickup portion.

Hereinafter, a sheet feeding device according to a second modification will be described with reference to the drawings. FIG. 12 is a top view of the sheet feeding device 21*b* according to the second modification. FIG. 13 is a diagram showing an image captured by the image pickup portion 93.

The sheet feeding device 21*b* differs from the sheet feeding device 21 in that a lens 95 is provided. More specifically, the lens 95 is provided in front of the image pickup portion 93 as shown in FIG. 12. The lens 95 magnifies an image of the foremost edge E1 of the sheet S1, the foremost edge E2 of the sheet S2, and their vicinities, as shown in FIG. 13.

The sheet feeding device 21*b* thus configured can also achieve the same effects as those achieved by the sheet feeding device 21. Further, the sheet feeding device 21*b* eliminates the need for the control circuit 15 to produce a combined image. Thus, processing load on the control circuit 15 is reduced.

Third Modification

Figure 14:
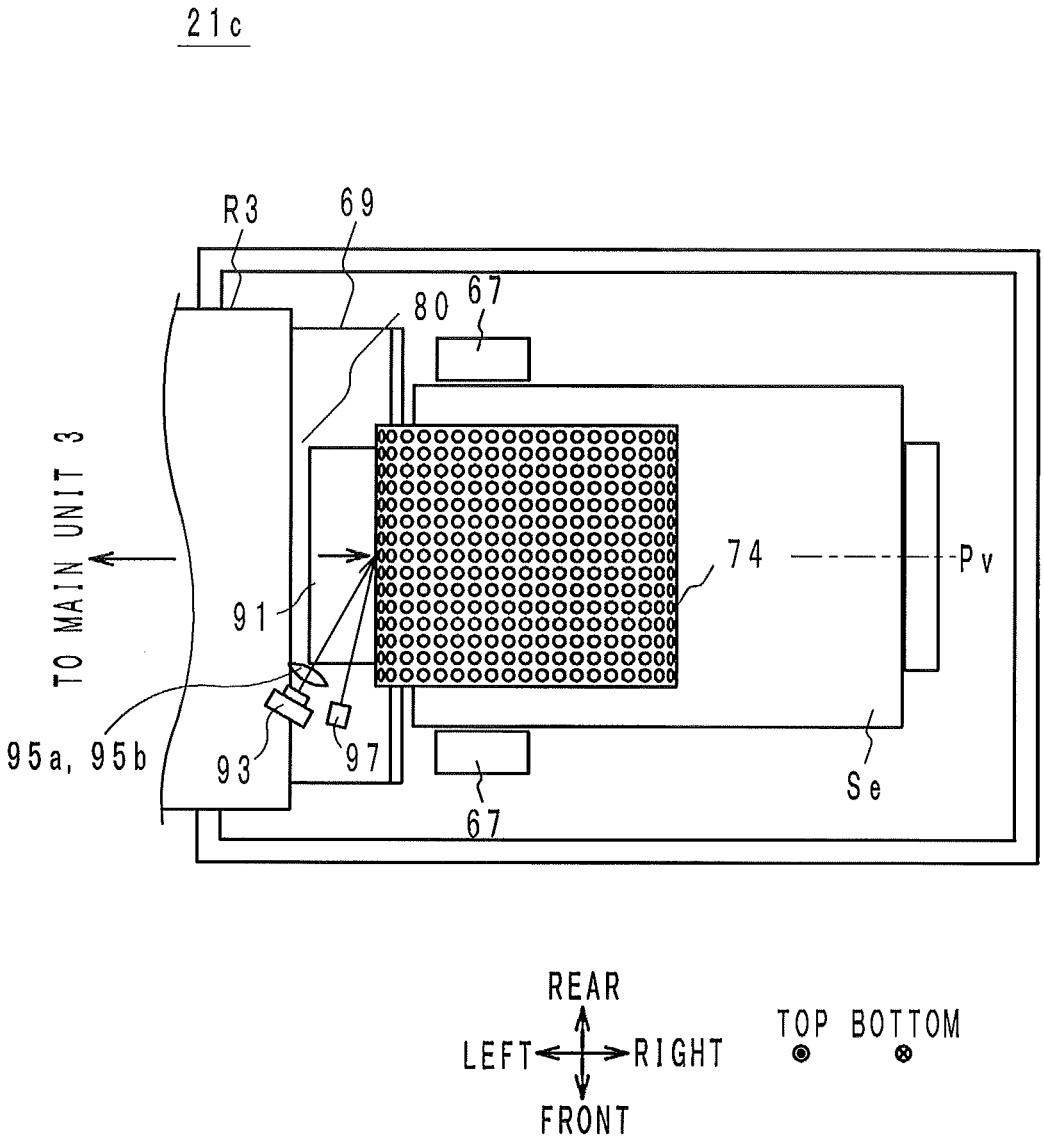
FIG. 14 is a top view of a sheet feeding device according to a third modification.
Figure 15:
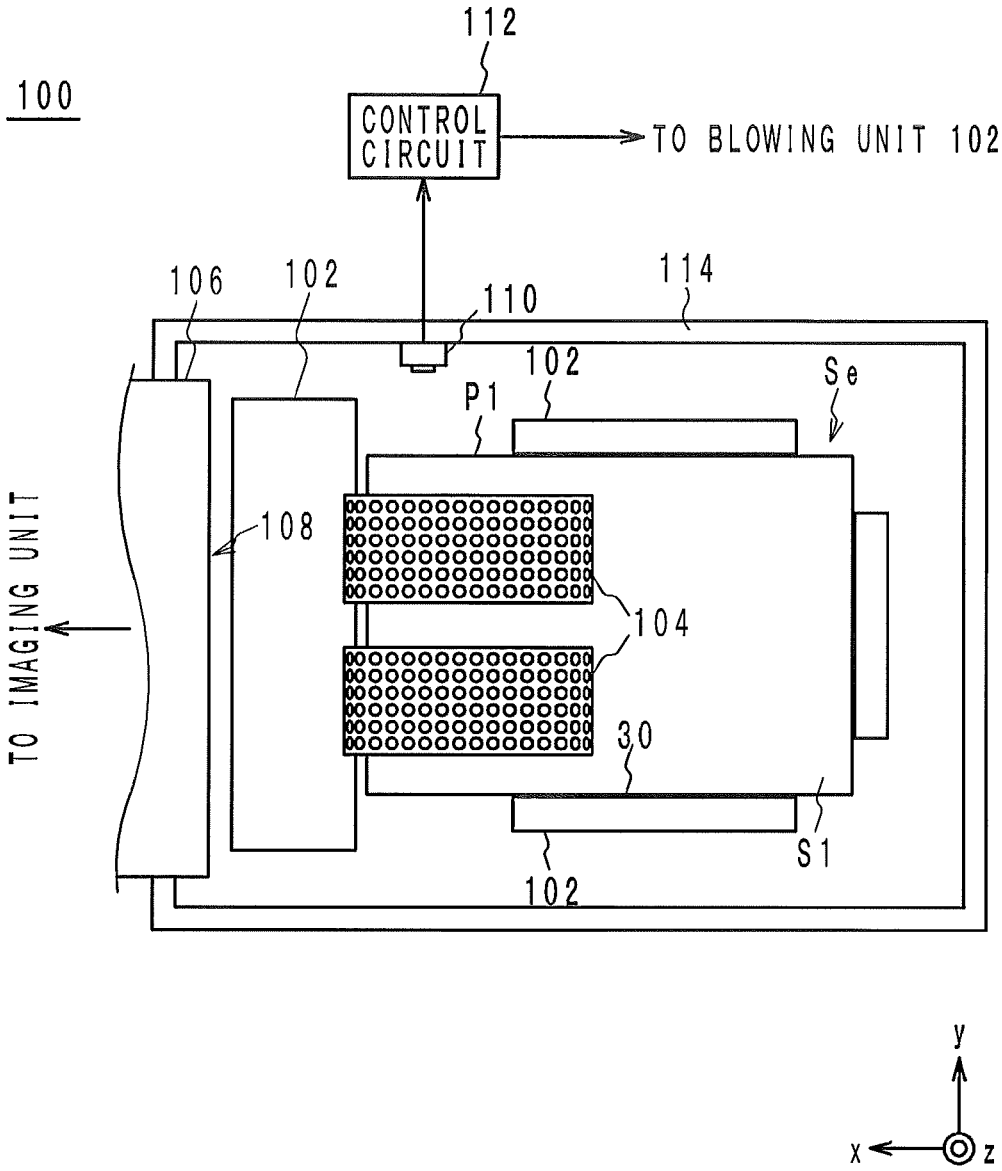
FIG. 15 is a configuration diagram of a sheet feeding device described in Japanese Patent Laid-Open Publication No. 2010-254462.

Hereinafter, a sheet feeding device according to a third modification will be described with reference to the drawings. FIG. 14 is a top view of the sheet feeding device 21*c* according to the third modification.

The sheet feeding device 21*c* differs from the sheet feeding device 21 in that lenses 95*a* and 95*b* are provided. More specifically, the lenses 95*a* and 95*b* are provided in front of the image pickup portion 93, as shown in FIG. 14. In the figure, the lenses 95*a* and 95*b* are shown as overlapping. The lens 95*a* is positioned above the lens 95*b*, and converges light in a narrow area around the foremost edge E1 of the sheet S1 and the foremost edge E2 of the sheet S2, such that an image as shown in the upper part of FIG. 9 is formed on the image pickup portion 93. On the other hand, the lens 95*b* converges light in a wide area around foremost edges of a plurality of sheets that are floating, such that an image as shown in the lower part of FIG. 9 is formed on the image pickup portion 93.

The sheet feeding device 21*c* thus configured can also achieve the same effects as those achieved by the sheet feeding device 21. Further, the sheet feeding device 21*c* eliminates the need for the control circuit 15 to produce a combined image. Thus, processing load on the control circuit 15 is reduced.

Other Embodiments

The present invention is not limited to the sheet feeding devices 21 and 21*a* to 21*c*, and various changes can be made within the spirit and scope of the invention.

In the sheet feeding devices 21 and 21*a* to 21*c*, the suction/transportation mechanism 61 inhibits the suction force from acting on the foremost edge E1 of the sheet S1 while the second blowing mechanism 69 is blowing separation air. However, in other embodiments, the suction/transportation mechanism 61 may apply the suction force to the foremost edge E1 of the sheet S1 while the second blowing mechanism 69 is blowing separation air. In such a case, the suction/transportation mechanism 61 is required to set the suction force applied to the foremost edge E1 of the sheet S1 smaller when the second blowing mechanism 69 blows air to the sheet S1 than when the suction/transportation mechanism 61 transports the sheet S1.

Although the present invention has been described in connection with the preferred embodiment above, it is to be noted that various changes and modifications are possible to those who are skilled in the art. Such changes and modifications are to be understood as being within the scope of the invention.

What is claimed is:

1. A sheet feeding device, comprising:

a mounting portion allowing a stack of sheets to be mounted in a top-bottom direction;

a suction/transportation portion provided above the mounting portion for attracting a first sheet positioned on top of the stack by a first suction force applied to a foremost edge of the first sheet and by a second suction force applied to a portion of the first sheet other than the foremost edge, the foremost edge of the first sheet being foremost in a transportation direction, the suction/transportation portion being configured to apply: (i) the first suction force from a first part of the suction/transportation portion, (ii) the second suction force from a second part of the suction/transportation portion that is upstream of the first part in the transportation direction, and (iii) a third suction force from a third part of the suction/transportation portion that is downstream of the first part in the transportation direction;

a blowing portion for blowing air to the foremost edge of the first sheet while the first sheet is being attracted by the suction/transportation portion, thereby separating the first sheet from a second sheet next to the first sheet; and a hardware processor configured to control the suction/transportation and the blowing portion such that:

(A) after the first sheet is separated from the second sheet, the suction/transportation portion transports the first sheet in the transportation direction;

(B) the first suction force applied to the foremost edge of the first sheet when the blowing portion blows air to the first sheet is set smaller than the first suction force when the suction/transportation portion transports the first sheet; and (C) the first suction force applied to the foremost edge of the first sheet when the blowing portion blows air to the first sheet is set smaller than the second suction force applied to the portion of the first sheet other than the foremost edge when (a) the blowing portion blows air to the first sheet and (b) the second suction force is applied simultaneously with the smaller first suction force, wherein the suction/transportation portion includes:

an endless belt having a number of holes provided therein;

a drive portion for rotating the belt;

a negative pressure generation portion for generating a negative pressure in a space within an inner circumference of the belt, thereby attracting the first sheet to an outer circumferential surface of the belt; and a shutter for covering holes in the belt corresponding to the foremost edge of the first sheet, and not covering holes in the belt corresponding to the portion of the first sheet other than the foremost edge, when the blowing portion blows air to the first sheet, wherein the first sheet is transported after having been separated from the second sheet, whereby the foremost edge of the first sheet passes the shutter to be attracted to the belt.

2. The sheet feeding device according to claim 1, wherein the suction/transportation portion inhibits the first suction force from acting on the foremost edge of the first sheet when the blowing portion is blowing air to the first sheet.

3. The sheet feeding device according to claim 1, wherein the suction/transportation portion further includes a shutter drive portion for covering the holes in the belt corresponding to the foremost edge of the first sheet when the blowing portion blows air to the first sheet and uncovering the holes in the belt corresponding to the foremost edge of the first sheet when the suction/transportation portion transports the first sheet.

4. The sheet feeding device according to claim 1, further comprising an image acquisition portion for capturing an image of the foremost edge of the first sheet and a foremost edge of the second sheet in the transportation direction when the blowing portion is blowing air to the foremost edge of the first sheet.

5. An image forming apparatus, comprising:

a sheet feeding device of claim 4; and a determination portion for determining whether or not the first sheet is in close contact with the second sheet on the basis of image data acquired by the image acquisition portion.

6. The image forming apparatus according to claim 5, wherein the determination portion determines a gap between the first sheet and the second sheet on the basis of the image data acquired by the image acquisition portion.

7. The image forming apparatus according to claim 5, wherein the determination portion determines whether or not the first sheet is in close contact with the second sheet on the basis of a magnified image of the foremost edge of the first sheet.

8. A sheet feeding method for a sheet feeding device equipped with a mounting portion allowing a stack of sheets to be mounted in a top-bottom direction, a suction/transportation portion provided above the mounting portion for attracting a first sheet positioned on top of the stack by a first suction force applied to a foremost edge of the first sheet and by a second suction force applied to a portion of the first sheet other than the foremost edge, the foremost edge of the first sheet being foremost in a transportation direction, the suction/transportation portion being configured to apply: (i) the first suction force from a first part of the suction/transportation portion, (ii) the second suction force from a second part of the suction/transportation portion that is upstream of the first part in the transportation direction, and (iii) a third suction force from a third part of the suction/transportation portion that is downstream of the first part in the transportation direction, a blowing portion for blowing air to the foremost edge of the first sheet while the first sheet is being attracted by the suction/transportation portion, thereby separating the first sheet from a second sheet next to the first sheet, and a hardware processor configured to control the suction/transportation and the blowing portion, the hardware processor being configured to control the suction/transportation and the blowing portion such that:

(A) after the first sheet is separated from the second sheet, the suction/transportation portion transports the first sheet in the transportation direction;

(B) the first suction force applied to the foremost edge of the first sheet when the blowing portion blows air to the first sheet is set smaller than the first suction force when the suction/transportation portion transports the first sheet; and (C) the first suction force applied to the foremost edge of the first sheet when the blowing portion blows air to the first sheet is set smaller than the second suction force applied to the portion of the first sheet other than the foremost edge when (a) the blowing portion blows air to the first sheet and (b) the second suction force is applied simultaneously with the smaller first suction force, wherein the suction/transportation portion includes:

an endless belt having a number of holes provided therein;

a drive portion for rotating the belt;

a negative pressure generation portion for generating a negative pressure in a space within an inner circumference of the belt, thereby attracting the first sheet to an outer circumferential surface of the belt; and a shutter for covering holes in the belt corresponding to the foremost edge of the first sheet, and not covering holes in the belt corresponding to the portion of the first sheet other than the foremost edge, when the blowing portion blows air to the first sheet, wherein the first sheet is transported after having been separated from the second sheet, whereby the foremost edge of the first sheet passes the shutter to be attracted to the belt.

9. The sheet feeding method according to claim 8, wherein the suction/transportation portion inhibits the first suction force from acting on the foremost edge of the first sheet when the blowing portion is blowing air to the first sheet.

10. The sheet feeding method according to claim 8, wherein the suction/transportation portion further includes a shutter drive portion for covering the holes in the belt corresponding to the foremost edge of the first sheet when the blowing portion blows air to the first sheet and uncovering the holes in the belt corresponding to the foremost edge of the first sheet when the suction/transportation portion transports the first sheet.

11. The sheet feeding method according to claim 8, wherein the sheet feeding device further includes an image acquisition portion for capturing an image of the foremost edge of the first sheet and a foremost edge of the second sheet in the transportation direction when the blowing portion is blowing air to the foremost edge of the first sheet.

12. A sheet feeding device, comprising:

a mounting portion allowing a stack of sheets to be mounted in a top-bottom direction;

a suction/transportation portion provided above the mounting portion for attracting a first sheet positioned on top of the stack by a first suction force applied to a foremost edge of the first sheet and by a second suction force applied to a portion of the first sheet other than the foremost edge;

a blowing portion for blowing air to the foremost edge of the first sheet in a transportation direction while the first sheet is being attracted by the suction/transportation portion, thereby separating the first sheet from a second sheet next to the first sheet; and a hardware processor configured to control the suction/transportation and the blowing portion such that:

(A) after the first sheet is separated from the second sheet, the suction/transportation portion transports the first sheet in the transportation direction;

(B) the first suction force applied to the foremost edge of the first sheet when the blowing portion blows air to the first sheet is set smaller than the first suction force when the suction/transportation portion transports the first sheet; and (C) the first suction force applied to the foremost edge of the first sheet when the blowing portion blows air to the first sheet is set smaller than the second suction force applied to the portion of the first sheet other than the foremost edge when (a) the blowing portion blows air to the first sheet and (b) the second suction force is applied simultaneously with the smaller first suction force, wherein the suction/transportation portion includes:

an endless belt having a number of holes provided therein;

a drive portion for rotating the belt;

a negative pressure generation portion for generating a negative pressure in a space within an inner circumference of the belt, thereby attracting the first sheet to an outer circumferential surface of the belt; and a shutter for covering holes in the belt corresponding to the foremost edge of the first sheet, and not covering holes in the belt corresponding to the portion of the first sheet other than the foremost edge, when the blowing portion blows air to the first sheet, and the first sheet is transported after having been separated from the second sheet, whereby the foremost edge of the first sheet passes the shutter to be attracted to the belt.

* * * * *